United States Patent [19]

De Barth

[11] 4,319,697

[45] Mar. 16, 1982

[54] AEROSOL CAN PRESSURE RELEASER

[76] Inventor: Robert E. De Barth, 1337 N. Broad St., Lansdale, Pa. 19446

[21] Appl. No.: 140,303

[22] Filed: Apr. 14, 1980

[51] Int. Cl.[3] ..... B65D 83/14

[52] U.S. Cl. ..... 222/80; 222/397

[58] Field of Search ..... 222/5, 80, 82, 83, 83.5, 222/85, 87, 396, 397; 9/318; 169/74; 220/267, 277, 278

[56] References Cited

U.S. PATENT DOCUMENTS

| | | | |
|---|---|---|---|
| 1,670,591 | 5/1928 | Merifield | 222/5 X |
| 1,759,336 | 5/1930 | Wollk | 222/5 |
| 3,241,713 | 3/1966 | Clapp et al. | 222/396 X |
| 3,303,968 | 2/1967 | Compère | 222/87 X |
| 3,333,735 | 8/1967 | Odasso | 222/80 X |
| 3,438,548 | 4/1969 | Ceyba | 222/80 |
| 3,712,319 | 1/1973 | Rhodes et al. | 222/5 X |

*Primary Examiner*—F. J. Bartuska

*Attorney, Agent, or Firm*—Raymond Underwood

[57] ABSTRACT

A lever is permanently attached to an aerosol can so it cannot be lost and the lever has a projecting pin which can be forced to penetrate the can to make a small hole for the complete release of the internal gas pressure.

7 Claims, 10 Drawing Figures

AEROSOL CAN PRESSURE RELEASER

Figure 1:
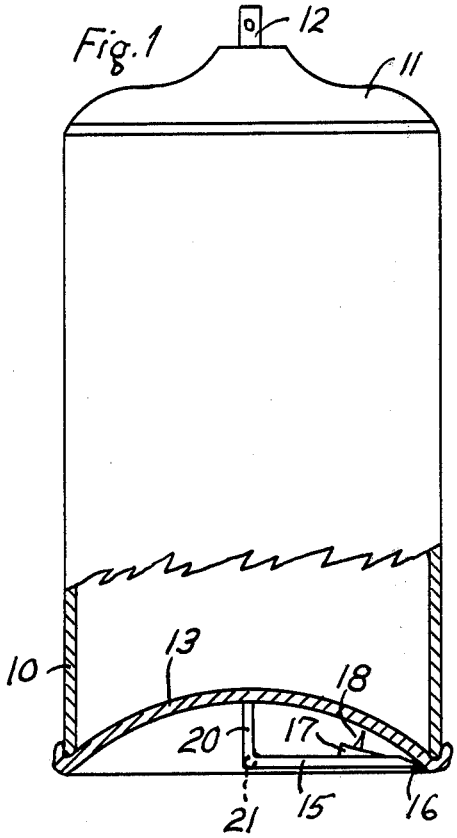

This invention relates to pressurized spray cans and particularly to means for readily releasing the residual pressure after its intended use is completed.

A representative pressurized spray can to which the invention may be applied is the well known so-called aerosol paint can. Its color pigment is suspended in a liquid vehicle which includes a propelling fluid which is a gas at atmospheric pressure and temperature but which is a liquid under the high pressure conditions within the can. A suitable propelling fluid is a low molecular weight fluoro-hydrocarbon sold under a Freon trademark.

In one end of the aerosol can is a spray nozzle or valve which can be released by pressure from a finger. The release of the pressure of the propelling fluid from the nozzle forms a spray which can be directed on the article or surface to be painted. The propelling fluid within the container expands into a considerable volume of gas in the atmosphere and consequently an extensive and prolonged spray normally comes from the can.

The result of this is that quite often all of the can's contents are not exhausted and pressurized paint remains in the container. All too frequently these cans are discarded and then found by unscrupulous vandals who use the remaining paint to deface public property. These thoughtlessly thrown away paint cans account, no doubt, for a considerable amount of the graffiti which plagues society.

It is unfortunate that the containers are not fully exhausted before they are thrown away but the cans themselves usually contain the warning that an ordinary can opener should not be used because of the danger of having the paint directed on the person. The problem of depressurizing the can has been recognized as is shown by U.S. Pat. No. 3,303,968 which issued to Compere on Feb. 14, 1967. It shows and describes a tool which is to be used to puncture the can to release its pressure. Another solution to the problem is shown in U.S. Pat. No. 3,438,548 which issued to Ceyba on Apr. 15, 1969. The big disadvantage of those pressure release devices is that they must be located, usually among numerous other kitchen or work room devices, in order to use them.

The feature of the present invention is that the pressure release means of the present invention is a part of the container and therefore it cannot be lost or mislaid. By having it integrally connected to the can it goes where the container goes and is always right at hand to be used to exhaust all of its pressure. Moreover, a preferred location of this release means is in the cupped under or bottom side of the can so that it is out of the way and cannot easily be disturbed.

Another feature of the invention is its simplicity and therefore its low cost. This is in marked contrast to the complex devices and their consequent costly production of the devices of the above mentioned patents.

Although the invention will particularly be described with reference to aerosol paint cans it is to be understood that the pressure release means can be provided on other cans such as those containing insecticides, herbicides, deodorants, hair sprays, whipped cream, furniture polish, etc. All of these substances can be harmful if the can is opened with a conventional can opener or if it is thrown in the fire and the can explodes.

Figure 3:
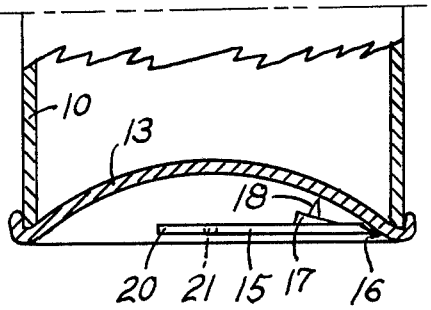
Figure 4:
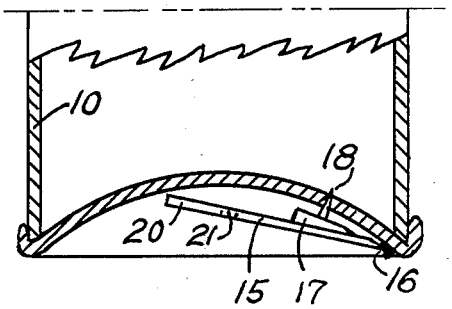
Figure 5:
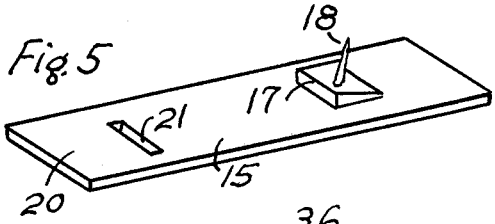
Figure 2:
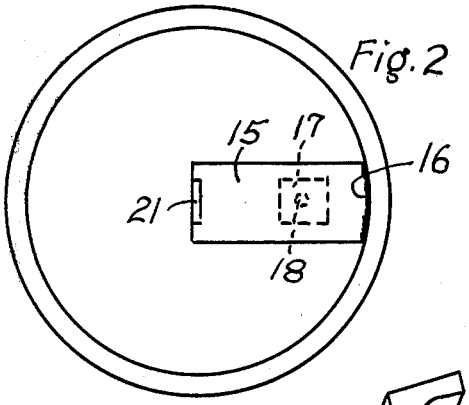
Figure 9:
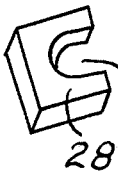
Figure 6:
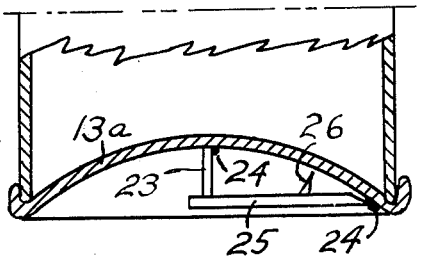
Figure 8:
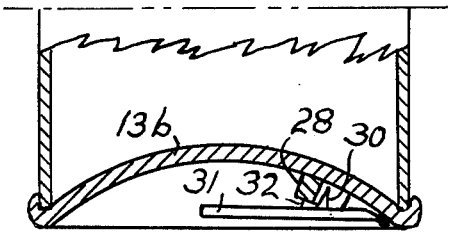
Figure 7:
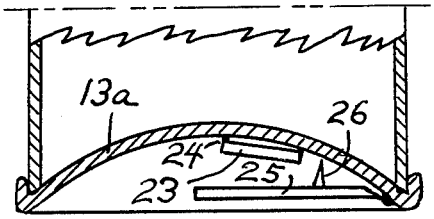

Representative embodiments of the invention are illustrated in the accompanying drawings in which:

FIG. 1 is a side elevational view of a conventional aerosol can with the lower portion broken away to show the structure on a vertical, diametrical plane, and is the preferred form, FIG. 2 is a view looking upward at the under side of FIG. 1, FIG. 3 is similar to FIG. 1 but shows the next step in using the puncture means, FIG. 4 is similar to FIG. 3 but shows the last step in using the puncture means, FIG. 5 is a plan view on an enlarged scale of the upper side of the puncture means as shown in FIG. 3, FIG. 6 is similar to FIG. 1 but shows a modification of the puncture means, FIG. 7 shows the next step in the use of the modification of FIG. 6, FIG. 8 is similar to FIG. 1 but shows another modification of the puncture means and FIG. 9 is a perspective view on an enlarged scale of the stop element in FIG. 8.

Figure 10:
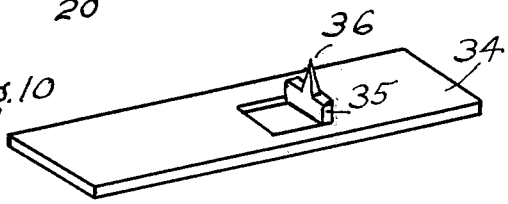

FIG. 10 shows a modified puncture means.

Referring first to the preferred embodiment of FIGS. 1 to 5, the aerosol can is made up of the cylindrical wall 10, the top cover plate 11 with the pressure release nozzle or valve 12 in it and the bottom plate 13 which is of dished or concave formation. Located within this cupped space is the lever 15 so it is shielded or protected against extraneous contact or disturbance during the spraying use of the aerosol can.

This lever 15 is a strip or band which is stiff or strong enough to resist bending when it is used to puncture the can in the manner to be explained. One end of the lever is permanently attached to the can, such as by a spot or a tack weld at 16. The point of attachment is preferably at or close to the rim as shown and the lever extends away from this attachment point so that it is close to but spaced from the bottom wall 13. On the upper side of the lever and near to the attachment at 16 is a block 17 which carries a sharp pointed puncture pin 18, the pin being directed toward the wall 13.

The block 17 and the pin 18 are welded together or the pin may be fixed in a hole in the block 17 and the block is welded on the top side of the lever. At its free end the lever 15 is provided with the angular extension 20 which is directed toward the bottom wall 13. Its function is to serve as a stop means to limit movement of the lever toward the bottom wall 13, thereby preventing the puncture pin 18 from entering the wall 13. Normally therefore the lever and its pin are in the position of FIG. 1 where they are obscured from view and they are protected from disturbance.

To use the lever and pin to puncture the can bottom and release the internal pressure the angular extension is pulled outwardly to the position of FIG. 3 so that the lever and its extension are disposed in a straight line. To facilitate this straightening out, a slot 21 is formed at the junction of the lever and its extension and at this weakened point the necessary bend can be made. Instead of the slot 21 there may be a groove or other weakened area to make it easy to go from the angular position of FIG. 1 to the aligned position of FIG. 3.

From the position of FIG. 3 the lever 15 can be pushed against the bottom wall 13 and this can be done because the extension 20 no longer is in the way to serve as a stop means. This movement of the lever is possible because the welding connection at 16 is yieldable enough or the can material is flexible enough at the rim to permit the lever to be pushed against the can and force the puncturing pin to pierce through the bottom wall 13; this will fully release the pressure remaining in the can. The principal function of the block 17 is to divert the escaping gas sidewise so that it does not discharge straight out of the hole and toward the person holding the can.

FIG. 4 shows the final stage as the pin has punctured the bottom of the can and the pressure is being released. The puncture pin is preferably quite small so that there will not be a great spurt of the paint or other aerosol material when the penetration is completed. The exhausted can may be freely discarded without fear that it will be used to write graffiti or be thrown in a fire; if it is thrown in a fire it will not explode.

FIGS. 6 and 7 show a modification in that the stop means 23 is yieldably attached to the bottom wall 13*a* instead of being an extension of the lever 25. The point of attachment is at 24 and it may be a spot or a tack weld. The stop means 23 prevents accidental movement of the lever 25 toward the wall 13*a* such as would cause the pin 26 to puncture the can.

To puncture the can the stop means is pushed to the location of FIG. 7 to the position where it does not prevent movement of the lever 25. In this manner the can bottom is penetrated and the remaining gas is exhausted. This FIG. 7 also shows that the block 17 of the preferred embodiment of FIG. 1 can be eliminated but care should be taken that the escaping stream is directed in a harmless direction.

Still another embodiment of the invention is shown in FIGS. 8 and 9. Neither the stop means 20 nor 23 is present; in their place as a limiting means is the stop block or means 28. It is a U-shaped block as it has the notch 29 in one of its sides and this notch receives the penetrating pin 30. The block 28 will prevent movement of the lever 31 toward the bottom wall 13*b* as it is located between the deflector block 32 (corresponding to 17) and the bottom wall of the can. The compressive bias of the lever 31 on the stop block 28 and the isolated and protected location of these parts will serve to retain the stop block 28 in position so that it limits inward movement of the lever.

To release the can pressure the stop block 28 is removed with the fingers and then the lever 31 is pushed toward the can so that the pin 30 penetrates the bottom wall. The escaping gas will be diverted away from the person by the deflector block 32 but, as is shown in FIGS. 6 and 7, this may be ommitted. In this latter case the stop block would merely be made thicker; it preferably would be made of rubber or of a resilient plastic.

The preferred location of the lever is in the cupped or recessed underside of the aerosol can as it is protected against movement and it does not interfere with the use of the can. It can be attached to another outside surface of the can but the important feature is that it is permanently fastened to the can. Because of this it cannot be mislaid and it is always immediately at hand to be used to fully exhaust the internal pressure.

The discharge of the residual pressure can be made into the same trash receptacle in which the can is to be discarded so that no extra steps are required for the final disposal. If it is picked out by a vandal it cannot be used to make graffiti and it does no harm if the can is thrown in a fire.

FIG. 10 shows an inexpensive form of the puncture means as the lever strip or band has a punched-out or up-struck portion 35 which remains attached to the strip 34. Its upper edge is pointed at 36 to penetrate the can bottom.

I claim:

1. A pressurized aerosol spray can having a cylindrical side wall and end closure plates, one end plate having a manually depressible release valve therein and the other end plate being concavely dished in shape, and in combination therewith a lever which is totally disposed in the space formed by said dished end plate and is permanently and yieldably attached at one of its ends to the can and extends therefrom to lie spaced from the dished end plate surface, the lever having a puncture pin on its side facing the dished surface so that movement of the permanently attached lever toward the can will cause the pin to enter and puncture the can.

2. The combination of claim 1 in which removeable stop means prevents movement of the lever toward the can to thereby prevent entry of the pin until the stop means is removed.

3. The combination of claim 2 in which said stop means is a bendable extension of the lever and normally is at an angle to the lever and directed toward the can surface.

4. The combination of claim 2 in which said stop means is yieldably attached to the can surface and is disposed between it and the lever.

5. The combination of claim 2 in which said stop means is a removable element disposed between the lever and the can surface.

6. The combination of claim 1 in which the attached end of the lever is at the edge of the bottom dished plate.

7. The combination of claim 1 in which the puncture pin is an up-struck portion of the lever.

* * * * *